United States Patent [19]

Wang et al.

[11] 4,206,045

[45] Jun. 3, 1980

[54] PROCESS FOR FROTH FLOTATION OF PHOSPHATE USING COMBINATION COLLECTOR

[75] Inventors: Samuel S. Wang, Chesire; Eugene L. Smith, Jr., Milford, both of Conn.

[73] Assignee: American Cyanamid Company, Stamford, Conn.

[21] Appl. No.: 967,554

[22] Filed: Dec. 7, 1978

[51] Int. Cl.[2] ..... B03D 1/02

[52] U.S. Cl. ..... 209/166

[58] Field of Search ..... 209/166, 167; 252/61; 260/513 N

[56] References Cited

U.S. PATENT DOCUMENTS

| | | | |
|---|---|---|---|
| 1,931,540 | 10/1933 | Hentrich | 260/513 N |
| 2,009,346 | 7/1935 | Schirm | 260/513 N |
| 2,198,806 | 4/1940 | Epstein | 209/166 X |
| 3,317,589 | 5/1967 | Vitalis | 260/513 N |
| 3,830,366 | 8/1974 | Day | 209/166 |

FOREIGN PATENT DOCUMENTS

| | | | |
|---|---|---|---|
| 17144 | 4/1934 | Australia | 209/166 |
| 194801 | 5/1957 | Austria | 209/166 |
| 659535 | 3/1963 | Canada | 209/166 |
| 731189 | 3/1966 | Canada | 260/513 N |
| 553982 | 6/1943 | United Kingdom | 209/166 |

*Primary Examiner*—Robert Halper

*Attorney, Agent, or Firm*—William J. vanLoo, Frank M. Van Riet

[57] ABSTRACT

Phosphate values are selectively froth floated from an aqueous ore pulp by use of a combination collector comprising a fatty acid and an N-alkyl substituted 3-sulfonic propionamide.

5 Claims, No Drawings

PROCESS FOR FROTH FLOTATION OF PHOSPHATE USING COMBINATION COLLECTOR

CROSS-REFERENCES TO RELATED APPLICATIONS

This application is related to Application Ser. No. 967,350, filed on Dec. 7, 1978, now abandoned. The present application relates to a process for froth floating phosphate ores using a combination collector of fatty acids and N-alkyl substituted 3-sulfonic propionamides. Application Ser. No. 967,350, relates to the composition of said combination collectors.

BACKGROUND OF THE INVENTION

Froth flotation is the principal means by which phosphate ores, such as pebble phosphate and apatite, and a host of other ores are concentrated. Its chief advantage lies in the fact that it is a relatively efficient process operating at substantially lower costs than many other processes capable of concentrating the ores.

Flotation is a process for separating finely ground valuable minerals from their associated gangue, or waste, or for separating valuable components one from another. In froth flotation, frothing occurs by introducing air into a pulp of finely divided ore and water containing a frothing agent. Minerals that have a special affinity for air bubbles rise to the surface in the froth and are separated from those wetted by the water. The particles to be separated by froth flotation must be of a size that can be readily levitated by the air bubbles.

Agents called collectors are used in conjunction with flotation to promote recovery of the desired material. The agents chosen must be capable of selectively coating the desired material in spite of the presence of many other mineral species. Current theory states that the flotation separation of one mineral species from another depends upon the relative wettability of surfaces. Typically, the surface free energy is purportedly lowered by the adsorbtion of heteropolar surface-active agents. The hydrophobic coating thus provided acts in this explanation as a bridge so that the particle may be attached to an air bubble. The practice of this invention is not, however, limited by this or other theories of flotation.

Typically, phosphate ore containing 15–35% BPL[bone phosphate of lime, $Ca_3(PO_4)_2$] is concentrated in very large tonnages from deposits such as the Florida pebble phosphate deposits. The ore slurry from strip mining is sized at about 1 millimeter and the coarser fraction, after scrubbing to break up mud balls, is a finished product. The minus 1 mm fraction is further sized at 35 and 200 mesh. The minus 200 mesh slime is discarded. From the sizing operation, the ±35 mesh material in thick slurry is treated with fatty acid, fuel oil, and caustic, ammonia or other alkaline material and the resulting agglomerates are separated on shaking tables, spirals, or spray belts. The 35×200 mesh fraction is conditioned with the same type of reagents and floated by conventional froth flotation routes. Not all the silica gangue is rejected by the fatty acid flotation so the concentrate is blunged with acid to remove collector coatings, deslimed, washed free of reagents and subjected to an amine flotation with fuel oil at pH 7–8. This latter flotation, sometimes called "cleaning", removes additional silica and raises the final concentrate grade to 75–80% BPL.

Although the procedure described is effective in the beneficiation of phosphate ores in general, there, nevertheless, exists the need for more effective collectors which provide increased recovery of phosphate minerals while still providing high grade. It is particularly desirable to reduce the requirements for fatty acids which are constantly being diverted to nutritional and other uses. In view of the high quantities of phosphate minerals processed by froth flotation, such a development can result in a substantial increase in the total amount of mineral values recovered and provide substantial economic advantages even when a modest increase in recovery is provided. It is also highly desirable to have an efficient collector system for use at reduced dosage levels without sacrificing the mineral recovery performance. The decreases in reagent consumption are significant in view of the increasing diversion of fatty acids to nutritional and other uses.

Accordingly, the provision for an improved process for beneficiating phosphate minerals would fulfill a long-felt need and constitute a significant advance in the art.

SUMMARY OF THE INVENTION

The present invention provides for a collector combination selective for phosphate minerals in froth flotation and a process for preparing the same. This collector combination enables higher recoveries to be achieved for phosphate minerals while concurrently decreasing the requirements for fatty acids. The synergistic results obtained are unexpectedly surprising in view of the fact that neither component alone provides such high recovery values as are exhibited by the combination of the present invention.

DESCRIPTION OF THE INVENTION

In accordance with the present invention, there is provided a process for the froth flotation of phosphate values from an aqueous ore pulp which comprises conditioning said ore pulp with 0.1 to 5.0 pounds of combination collector per ton of ore, said combination collector comprising from about 99.0 to 1.0 weight percent of a fatty acid derived from vegetable or animal oils and, correspondingly, from about 1.0 to 99.0 weight percent of an N-alkyl substituted 3-sulfonic propionamide of the general structure:

$$R-NH-\overset{\overset{\displaystyle O}{\|}}{C}-CH_2CH_2SO_3^{(-)}M^{(+)}$$

wherein R is a saturated or unsaturated aliphatic radical of 12 to 26 carbon atoms inclusive, and M is a cationic forming radical, and thereafter froth floating off the phosphate values, optionally with the addition of fuel oil.

The fatty acid employed in the collector combination is one derived from a vegetable or animal oil. Illustrative vegetable oils include babassu, castor, Chinese tallow, coconut, corn, cottonseed, grapeseed, hempseed, kapok, linseed, wild mustard, oiticica, olive, ouri-ouri, palm, palm kernel, peanut, perilla, poppyseed, Argentine rapeseed, rubberseed, safflower, sesame, soybean, sugarcane, sunflower, tall, teaseed, tung and ucuhuba oils. Animal oils include fish and livestock oils. These oils contain acids ranging from six to twenty-eight carbon atoms or more which may be saturated or unsaturated, hydroxylated or not, linear or cyclic and the like.

Suitable N-alkyl substituted 3-sulfonic propionamides may be prepared by any conventional procedure, however for purpose of illustration, the following procedure for preparing a N-alkyl substituted 3-sulfonic propionamide from an alpha olefin and an acrylonitrile is outlined, it being understood, however, that this invention is not limited to the precise procedure shown, but that any conventional procedure for preparation of the N-alkyl substituted 3-sulfonic propionamides may be employed without thereby departing from the spirit or essential attributes of the invention.

Suitable alpha olefins are of the general structure:

$$R'-CH=CH_2 \qquad \text{(II)}$$

wherein R' is a saturated or unsaturated aliphatic radical of 10 to 24 carbon atoms inclusive.

The olefin is reacted with an acrylonitrile under the conditions of the Ritter reaction wherein the reaction temperature is in the range of 20° to 70° C., preferably 40° to 50° C. The reaction takes place in the presence of concentrated sulfuric acid and an inhibitor such as hydroquinone or its equivalent. Equal molar equivalents of both olefin and acrylonitrile are employed. The concentrated sulfuric acid is present in quantities of 1.0 to 2.0 moles of concentrated sulfuric acid for every 1.0 mole of either olefin or acrylonitrile. The hydroquinone is present in an amount equal to 1.0 weight percent of the olefin and acrylonitrile charge.

$$R'-\underset{}{\overset{CH_3}{\overset{|}{CH}}}-NH-\overset{O}{\overset{\|}{C}}-CH_2=CH_2 \qquad \text{(III)}$$

This reaction product is then sulfonated with a sulfite in the presence of sodium hydroxide and hydroquinone. Water and isopropanol may be added as the product of this reaction is refluxed. The final reaction product is an N-alkyl substituted 3-sulfonic propionamide corresponding to general structure (I).

The specified collector combination of this invention provides superior results in the froth flotation of phosphate ores than obtained with either component alone and leads to high recovery at lower dosage requirements. In preferred instances, fatty acid requirements can be reduced by as much as 50% while still maintaining high mineral recovery and grade.

In utilizing the collector combination of the present invention, a phosphate mineral is selected for treatment. The selected mineral is screened to provide particles of flotation size according to conventional procedures. Generally, the flotation size will encompass from about 35 to 200 mesh particles.

After the selected mineral has been sized as indicated, it is slurried in aqueous medium and conditioned with an effective amount of the collector combination. Generally, the effective amount will be found in the range of about 0.1 to 5.0 pounds per ton of ore, preferably 0.5 to 2.0 pounds per ton of ore, although variations outside this range may occur depending upon the specific ore processed, the quantity and nature of gangue material, the specific collector combination being used, the particular values of recovery and grade desired and the like. Phosphate minerals, in general, are floated at a pH value in the range of about 6.0 to 12.0, preferably about 8.0 to 10.0. Suitable additional additives such as pH regulator, frothers, fuel oil, and the like may be added in conjunction with conventional procedures. Specifically fuel oil is preferably employed to control the excessive frothing that is commonplace in the froth flotation of phosphate ores.

After the slurry has been conditioned as indicated, it is subjected to froth flotation following conventional practice. The desired mineral values are recovered with the froth while the gangue remains behind.

In order to evaluate the combination of the present invention as a collector for phosphate ores, the following general procedure is followed. The mineral processed is phosphate rock from the Florida deposits of pebble phosphate. All parts and percentages indicated are by weight unless otherwise specified.

GENERAL PROCEDURE

Rougher Float

Step 1: Secure washed and sized feed, e.g., 35×150 mesh screen fractions. Typical feed is usually a mixture of 23% coarse with 77% fine flotation particles.

Step 2: Sufficient wet sample, usually 640 parts, to give a dry weight equivalent of 500 parts is washed once with about an equal amount of water. The water is carefully decanted to avoid loss of solids.

Step 3: The moist sample is conditioned for two minutes with approximately 100 cc of water, sufficient caustic as 5–10% aqueous solution to obtain a pH of 9.0, a mixture of 50% fatty acid as the collector and No. 5 fuel oil as a froth supressor. Additional water may be necessary to give the mixture the consistency of "oatmeal" about 69% solids). The amount of caustic will vary from 4 to about 20 drops. This is adjusted with a pH meter for the correct endpoint. At the end of the condition, additional caustic may be added to adjust the endpoint. However, an additional 15 seconds of conditioning is required if additional caustic is added to adjust the pH. Five to about 200 drops of acid-oil mixture and one-half this amount of additional oil is used, depending on the treatment level desired.

Step 4: Conditioned pulp is placed in an 800-gram bowl of a flotation machine and approximately 2.6 liters of water are added (enough water to bring the pulp level to lip of the container). The percent solids in the cell is then about 14%. The pulp is floated for 2 minutes with air introduced after 15 seconds of mixing.

Step 5: The excess water is carefully decanted from the rougher products. The tails are set aside for drying and analysis.

Step 6: The products are oven dried, weighed, and analyzed for percent bone phosphate of lime (hereinafter referred to as BPL). Recovery of the mineral values is calculated using the formula:

$$\frac{(W_c P_c)}{(W_c)(P_c) + (W_t)(P_t)} \times 100$$

wherein $W_c$ and $W_t$ are the oven-dry weights of the concentrate and tailings, respectively, and $P_c$ and $P_t$ are the weight percent of BPL of the concentrate and tailings, respectively.

Whereas the exact scope of the present invention is set out in the appended claims, the following specific examples are set forth for the purposes of illustration only and are not to be construed as limitations on the present invention. All parts and percentages are again by weight unless otherwise specified.

COMPARATIVE EXAMPLE A

Following the general procedure outlined above, Florida pebble phosphate rock is froth floated using a fatty acid collector derived from tall oil in conjunction with a recycled motor oil at pH 9.0 as a control standard. Results and test details are contained in Table I.

COMPARATIVE EXAMPLE B

Following the procedure of comparative Example A in every material detail except that in place of the fatty acid collector there is used as N-alkyl substituted 3-sulfonic propionamide of the general structure:

$$C_{18}H_{37}-NH-\overset{O}{\overset{\|}{C}}-CH_2CH_2SO_3^{(-)}Na^{(+)}$$

Phosphate ore is again froth floated. Results and test details are contained in Table I.

EXAMPLES 1–9

Following the general procedure outlined above, Florida pebble phosphate rock is froth floated using a combination of a fatty acid derived from tall oil and as N-alkyl substituted 3-sulfonic propionamide of the same general structure as employed in comparative Example B. Results and test details are contained in Table I.

TABLE I

SYNERGISTIC PERFORMANCE OF FATTY ACIDS WITH N-ALKYL SUBSTITUTED 3-SULFONIC PROPIONAMIDES IN PHOSPHATE ORE FLOTATION

| Example | Collector Ratio* | Dosage (lbs/ton) | RMO Dosage (lbs/ton)** | Percent Wt. Recovery | Assays (% BPL) Feed | Tail | Conc. | Percent BPL Recovery |
|---|---|---|---|---|---|---|---|---|
| Comp. A | 100/0 | 0.4 | 0.8 | 10.01 | 14.61 | 9.16 | 63.62 | 43.58 |
| 1 | 90/10 | 0.4 | 0.8 | 23.97 | 15.88 | 2.73 | 57.57 | 86.92 |
| 2 | 80/20 | 0.4 | 0.8 | 25.94 | 15.37 | 1.73 | 54.33 | 91.67 |
| 3 | 70/30 | 0.4 | 0.8 | 26.87 | 15.48 | 2.12 | 51.84 | 89.98 |
| 4 | 60/40 | 0.4 | 0.8 | 25.01 | 15.11 | 2.23 | 54.71 | 88.93 |
| 5 | 50/50 | 0.4 | 0.8 | 26.48 | 14.50 | 1.73 | 49.97 | 91.23 |
| 6 | 40/60 | 0.4 | 0.8 | 24.47 | 14.64 | 1.78 | 54.33 | 90.82 |
| 7 | 30/70 | 0.4 | 0.8 | 25.31 | 14.63 | 2.23 | 51.21 | 88.61 |
| 8 | 20/80 | 0.4 | 0.8 | 21.97 | 15.19 | 3.29 | 57.45 | 83.10 |
| 9 | 10/90 | 0.4 | 0.8 | 23.79 | 15.07 | 2.79 | 54.39 | 85.89 |
| Comp. B | 0/100 | 0.4 | 0.8 | 2.57 | 13.38 | 12.23 | 56.82 | 10.92 |

*Ratio of weight percent fatty acid to N-alkyl substituted 3-sulfonic propionamide
**RMO = recycled motor oil.

As the data exhibited in Table I clearly demonstrates, the collector combination of the present invention, when used as a collector for phosphate ores, displays superior recovery results in comparison to either of its component parts alone.

EXAMPLE 10

The procedure of Examples 1–9 is followed in every material detail except that the N-alkyl substituted 3-sulfonic propionamide employed is of the general structure:

$$C_{14}H_{29}-NH-\overset{O}{\overset{\|}{C}}-CH_2CH_2SO_3^{(-)}Na^{(+)}$$

Results and test details are contained in Table II.

TABLE II

PERFORMANCE OF FATTY ACIDS WITH N-ALKYL SUBSTITUTED 3-SULFONIC PROPIONAMIDES

| Example | Collector Ratio* | Dosage (lbs/ton) | RMO Dosage (lbs/ton)** | Percent Wt. Recovery | Assays (% BPL) Feed | Tail | Conc. | Percent BPL Recovery |
|---|---|---|---|---|---|---|---|---|
| Comp. A | 100/0 | 0.4 | 0.8 | 10.01 | 14.61 | 9.16 | 63.62 | 43.58 |
| 10 | 30/70 | 0.4 | 0.8 | 19.93 | 15.48 | 4.58 | 59.28 | 76.31 |
| Comp. B | 0/100 | 0.4 | 0.8 | 2.57 | 13.38 | 12.23 | 56.82 | 10.92 |

*Ratio of weight percent fatty acid to N-alkyl substituted 3-sulfonic propionamide.
**RMO = recycled motor oil.

EXAMPLE 11

Following the procedure of Examples 1–9 in every material detail except that the N-alkyl substituted 5-sulfonic propionamide is of the general structure:

$$C_{12}H_{25}-NH-\overset{O}{\overset{\|}{C}}-CH_2CH_2SO_3^{(-)}K^{(+)}$$

substantially equivalent results are obtained.

EXAMPLE 12

Following the procedure of Examples 1–9 in every material detail except that the N-alkyl substituted 3-sulfonic propionamide is of the general structure:

$$C_{24}H_{49}-NH-\overset{O}{\overset{\|}{C}}-CH_2CH_2-SO_3^{(-)}NH^{(+)}$$

substantially equivalent results are obtained.

EXAMPLE 13

Following the procedure of Examples 1–9 in every material detail, except that in place of a fatty acid derived from tall oil there is used a fatty acid derived from olive oil, substantially equivalent results are obtained.

EXAMPLE 14

Following the procedure of Examples 1–9 in every material detail, except that in place of a fatty acid derived from tall oil there is used a fatty acid derived from fish oil, substantially equivalent results are obtained.

EXAMPLE 15

Following the procedure of Examples 1–9 in every material detail, except that recycled motor oil was not added, with the exception that frothing foam increased, substantially equivalent results are obtained.

EXAMPLES 16–25

Following the general procedure outlined above, Florida pebble phosphate rock is froth floated using a combination of a fatty acid and an N-alkyl substituted 3-sulfonic propionamide of the general structure:

$$C_{10\text{-}24}H_{21\text{-}49}-\overset{\overset{\displaystyle CH}{|}}{C}H-NH-\overset{\overset{\displaystyle O}{\|}}{C}-CH_2-CH_2SO_3^{(-)}Na^{(+)}$$

Results and test details, as well as comparative examples are given in Table III.

TABLE III

SYNERGISTIC PERFORMANCE OF FATTY ACIDS WITH N-ALKYL SUBSTITUTED 3-SULFONIC PROPIONAMIDES IN PHOSPHATE ORE FLOTATION (ph ≈ 9.0-Fuel Oil Ratio = 1:1)

| Example | Collector[1*] Ratio | lbs/ton[2,3] | Percent Wt. Recovery | Assays (% BPL) Feed | Tail | Conc. | Percent BPL Recovery | Conc. Insol. |
|---|---|---|---|---|---|---|---|---|
| Comp. C | 100/0 | 0.8 | 22.45 | 23.04 | 9.72 | 69.06 | 67.29 | 10.81 |
| 16 | 95/5 | 0.8 | 31.22 | 22.89 | 4.37 | 63.68 | 86.87 | 17.84 |
| 17 | 90/10 | 0.8 | 30.44 | 22.93 | 4.80 | 64.37 | 85.44 | 16.48 |
| 18 | 80/20 | 0.8 | 33.62 | 22.60 | 3.34 | 60.62 | 90.19 | 21.45 |
| 19 | 70/30 | 0.8 | 34.63 | 22.87 | 2.21 | 61.87 | 93.68 | 20.00 |
| 20 | 60/40 | 0.8 | 35.14 | 22.35 | 1.62 | 60.62 | 95.30 | 21.80 |
| 21 | 50/50 | 0.8 | 34.39 | 22.46 | 1.67 | 62.12 | 95.12 | 20.00 |
| 22 | 40/60 | 0.8 | 34.73 | 22.09 | 1.56 | 60.68 | 95.39 | 20.99 |
| 23 | 30/70 | 0.8 | 33.60 | 22.54 | 2.16 | 62.81 | 93.64 | 19.01 |
| 24 | 20/80 | 0.8 | 32.37 | 22.10 | 1.72 | 64.68 | 94.74 | 16.67 |
| 25 | 10/90 | 0.8 | 31.45 | 21.77 | 1.62 | 65.68 | 94.90 | 14.45 |
| Comp. D | 0/100 | 0.8 | 13.23 | 22.80 | 15.71 | 69.99 | 40.60 | 10.08 |

[1*]Same as in Table II.
[2]Collector Levels reported on an active solids basis.
[3]1:1 mix with No. 5 feed oil.

We claim:

1. A process for the froth flotation of phosphate values from an aqueous ore pulp which comprises conditioning said ore pulp with 0.1 to 5.0 pounds of combination collector per ton of ore, said combination collector comprising from about 99.0 to 1.0 weight percent of a fatty acid derived from vegetable or animal oils and, correspondingly, from about 1.0 to 99.0 weight percent of an N-alkyl substituted 3-sulfonic propionamide of the general structure:

$$R-NH-\overset{\overset{\displaystyle O}{\|}}{C}-CH_2CH_2SO_3^{(-)}M^{(+)}$$

wherein R is a saturated or unsaturated aliphatic radical of 12 to 26 carbon atoms inclusive, and M is a cationic forming radical, and thereafter froth floating off the phosphate values, optionally with the addition of fuel oil.

2. The process of claim 1 wherein R is an aliphatic radical of 14 to 20 carbon atoms inclusive.

3. The process of claim 1 wherein said collector combination dosage is in the range of 0.5 to 2.0 pounds per ton of ore.

4. The process of claim 1 wherein a fuel oil is added.

5. The process of claim 1 wherein said collector combination comprises from 90.0 to 10.0 weight percent of a fatty acid and, correspondingly, from 10.0 to 90.0 weight percent of an N-alkyl substituted 3-sulfonic propionamide.

* * * * *